US005184556A

United States Patent [19]

Schaeuble

[11] Patent Number: 5,184,556

[45] Date of Patent: Feb. 9, 1993

[54] PRINTING APPARATUS AND METHOD

[75] Inventor: Edwin K. Schaeuble, Green Bay, Wis.

[73] Assignee: Paper Converting Machine Company, Green Bay, Wis.

[21] Appl. No.: 837,823

[22] Filed: Feb. 18, 1992

[51] Int. Cl.[5] ..... B41M 1/00; B41F 31/02

[52] U.S. Cl. ..... 101/483; 101/366; 101/424; 101/207; 101/351

[58] Field of Search ..... 101/120, 157, 169, 202, 101/207, 208, 209, 210, 350, 351, 352, 424, 483, 366

[56] References Cited

U.S. PATENT DOCUMENTS

| | | | |
|---|---|---|---|
| 2,981,182 | 4/1967 | Dietrich | 101/366 |
| 4,023,486 | 5/1977 | Linthicum et al. | 101/120 |
| 4,150,621 | 4/1979 | Raible | 101/207 |
| 4,709,631 | 12/1987 | Davey et al. | 101/120 X |
| 4,920,914 | 5/1990 | Zimmer | 101/120 X |
| 5,099,758 | 3/1992 | Hassler et al. | 101/120 |

*Primary Examiner*—Edgar S. Burr
*Assistant Examiner*—Christopher A. Bennet
*Attorney, Agent, or Firm*—Tilton, Fallon, Lungmus & Chestnut

[57] ABSTRACT

A method and apparatus for printing for which turret having a plurality of fountain and doctor blade assembly is translatably, indexably mounted adjacent a transfer roll.

5 Claims, 2 Drawing Sheets

PRINTING APPARATUS AND METHOD

BACKGROUND AND SUMMARY OF INVENTION

This invention relates to a printing apparatus and method and, more particularly, to a fountain-providing turret which facilitates both doctor blade and applied liquid changeover.

One of the advantageous uses of the invention is in connection with flexographic presses. One of the largest costs in the flexographic printing industry is the time required to change the press from one job to the next. This changeover process typically involves: (1) draining the ink from the doctor blade/fountain assembly, (2) wiping the anilox roll clean, (3) cleaning or removing the doctor blade holder, (4) installing new doctor blades, (5) replacing the plate roll (new job) and (6) filling system with new ink. These steps can take up to one hour per press deck.

Historically, several systems for shortening these change times have been tried, however, none of the automatic washup systems currently employed provide a complete cleaning of the doctor blade holder. Moreover, the problem of doctor blade change time has not been addressed.

According to the invention, the changeover time is substantially reduced by providing a plurality of fountain and doctor blade assembly positions on a common rotatable turret. Fluid may be routed through the doctor blade fountain or chamber as can cleansing fluid.

Other objects and advantages of the invention may be seen in the details in the ensuing specification.

BRIEF DESCRIPTION OF THE DRAWING

The invention is described in conjunction with the accompanying drawing, in which.

DETAILED DESCRIPTION

Figure 1:
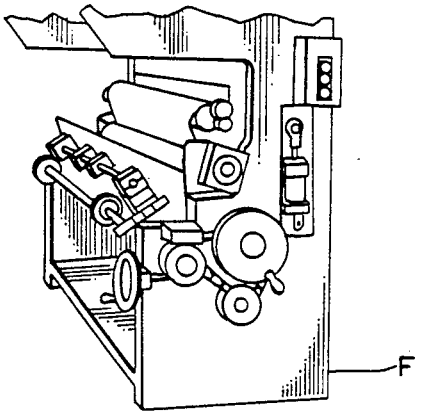
FIG. 1 PRIOR ART
FIG. 1 is a perspective view of a printing press according to the prior art co-owned Patent RE 30,819 which shows generally the field of application of the instant invention.

Referring first to FIG. 1 which is captioned PRIOR ART, the designation F refers to a frame which consists of two side frames joined together by suitable cross members. The press as seen in FIG. 1 also includes a plate roll, an anilox roll and a fountain equipped with doctor blades. This is the general environment in which the invention operates.

Figure 2:
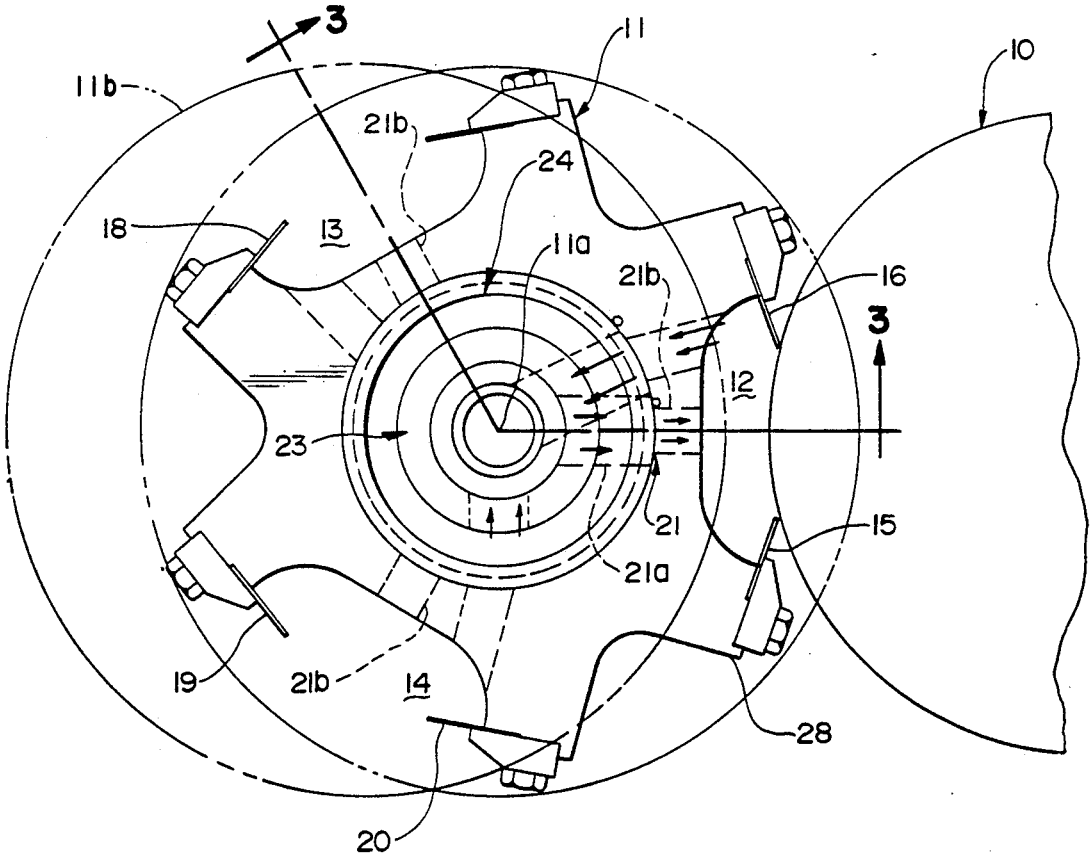
FIG. 2 is an enlarged side elevational view of the inventive turret as applied to a transfer roll.

Referring now to FIG. 2, the numeral 10 designates generally an anilox roll. More generally, this roll can be a wide variety of rolls which are employed for fluid transfer—as in the application of adhesive as well as printing ink. For example, not only could the equipment be in the nature of a printing press but also could be a printer for tissue for rewinder lines, a tissue laminator, etc.

The numeral 11 designates generally the inventive turret which is an elongated member such as an extrusion having three fountains or chambers as at 12, 13 and 14. The elongated turret 11 has an axis of rotation or indexing 11*a* and, in the illustration given, the fountains 12–14 are equally spaced circumferentially or perimetrically about the axis 11*a*. A greater or lesser number of fountains (at least two) can be used to advantage depending upon the application and design features. Each fountain or chamber 12–14 is defined by an axially extending recess in the turret member 11. As illustrated, each fountain is further defined by doctor blades as at 15 and 16 relative to the fountain 12; blades 17 and 18 relative to the fountain 13 ad blades 19 and 20 relative to the chamber or fountain 14. The free edges of each of the doctor blades are equally spaced radially or outwardly from the axis 11*a*. This insures that the doctor blades will properly engage the fluid transfer roll 10.

Figure 3:
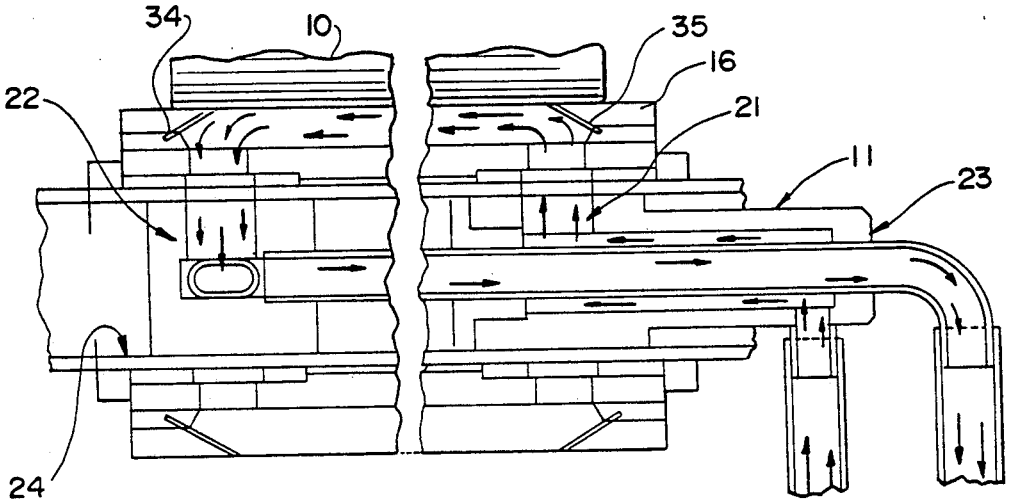
FIG. 3 is a sectional view taken along line 3—3 of FIG. 2.

Conduit means generally designated 21 are provided in the turret member 11 for delivering fluid to the fountain 12 which is seen to be in transfer relationship with the anilox roll 10. As illustrated in FIG. 2, the conduit means 21 are shown coupled to the fountain 12 and there are return conduit means generally designated 22 which can be used for recycling or returning the fluid not taken up by the roll 10—see also FIG. 3.

A wide variety of delivery and return conduit means can be employed—again depending upon the requirements or advantages of a particular installation. Very often, a very simple conduit system is employed which consists of flexible hoses coupled to ports which in turn communicate with the fountain recess. The conduit means illustrated are just one example and are seen to include a stationary tubular member generally designated 23 which is positioned within a cored or otherwise-provided axially extending opening generally designated 24 in the turret member 11.

Referring specifically to the central portion of FIG. 2, it will be seen that the conduit means 21 includes a first part 21*a* which is stationary and a second part 21*b* which is indexable along with the turret 11. Thus, in the illustration given I provide the indexable conduits at positions 21*b* relative to the fountain 13 and again 21*b* relative to the fountain 14.

It is believed that at this point, the invention can be better appreciated from a consideration of a typical operation of apparatus as seen in FIG. 2.

SUMMARY OF OPERATION

A typical printing and cleanup cycle would include two or three types of fluids:

Ink can be routed to the inlet conduit means 21 and returned to the ink reservoir via the return conduit means 22. Then, at the conclusion of a particular run (whether it be printing via ink, adhesive application, etc.), the ink is drained from the coupling hoses (not shown) and the fountain-doctor blade assembly. Thereafter, cleaning solvent is routed through the doctor blade chamber 12 in a manner similar to the ink flow. During this part of the cycle, the anilox roll can continue to rotate at a slow speed. Normally this is provided in presses of the nature involved by what is called "Sunday drive".

Several cleaning cycles may be used with varying solvents and/or possibly reversing the flow direction. A third fluid, such as compressed air, may finally be used to drive out the remaining solvents.

Figure 4:
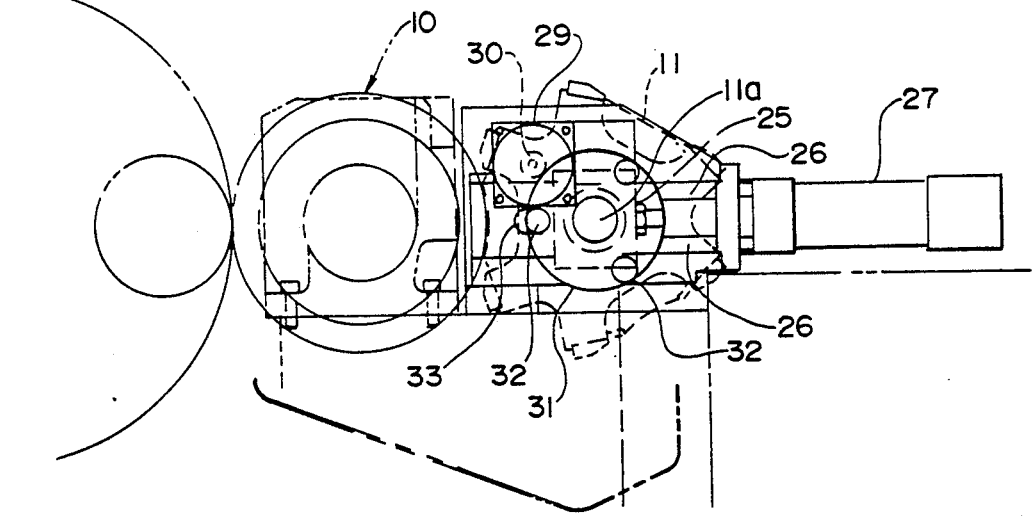
FIG. 4 is another side elevational view featuring the translating and indexing means of the invention.

Once the cleaning cycle is complete the turret 11 is retracted away from the roll 10. This can be appreciated from a consideration of FIG. 4. In FIG. 4, the numeral 10 again indicates the position of the anilox or transfer roll and the numeral 11*a* designates the axis of rotation of the turret 11. The ends of the turret carry subframes 25 which slide in gibs or ways 26 provided on the same subframe that carries the anilox roll.

Connected to the subframe 25 is a retraction means 27 which may be in the nature of a pressure fluid cylinder, ball and screw arrangement, etc. and which operates to retract the turret 11 to the position 11*b* (see FIG. 2) which is sufficiently away from the anilox or transfer roll 10 so as to permit indexing of the turret 11 and the passage by the anilox roll 10 of the doctor blade holders 28 (FIG. 2). Once the turret 11 has been retracted, indexing, i.e., rotation, is performed so as to move the fountain 12 up to the position 13 designated in FIG. 2. This results in positioning fresh blades in the working position designated 12 in FIG. 1.

At this time, assuming the anilox roll 10 and associated plate roll, etc. are ready, the turret 11 can be brought forward so as to load the new blades against the anilox roll and new ink is circulated through the doctor blade chamber or fountain and a second run of printing can begin. With the used blades in the position of designated 13 in FIG. 2, the used blades may now be removed, the old doctor blade fountain chamber thoroughly cleaned and new blades installed.

In some instances, the invention can be used to advantage in changing a doctor blade only. For example, it is not uncommon to have a given run extend over two days, viz., six shifts. It is common in the printing trade to replace the doctor blades each shift and the instant invention provides for an efficient and time-saving way of doing this. In the past, the operator and an assistant had to be employed to manually lift out and switch the doctor blades or, in some cases, the doctor blade holders.

Referring again to FIG. 4, it will be noted that the turret 11 is seen in dashed line and the axis of rotation is again designated 11*a*. The indexing or rotation is achieved by virtue of a stepping motor 29 driving a pinion gear 30 in engagement with gear 31 provided coaxially with the turret 11. The stepping motor is programmed to index the turret 120° after which a locating, stabilizing pin 32 enters a slot 33 to restrain the turret against further rotational movement. It will be noted that the pins 32 are circumferentially spaced apart corresponding to the various fountains and enter into the slot 33 under the influence of the retraction unit 27.

Again, a variety of supply and return conduit means may be employed. By the same token, a variety of doctor blades and, for that matter end seals such as those shown at 34 and 35 of FIG. 3 may be employed.

While in the foregoing specification a detailed description of an embodiment of the invention has been set down for the purpose of illustration, many variations in the details herein given may be made by those skilled in the art without departing from the spirit and scope of the invention.

I claim:

1. A printing press or the like comprising a frame, a fluid transfer roll rotatably mounted on said frame, an elongated, multiple position turret rotatably mounted on said frame and having an axis of rotation and positioned adjacent said roll, a plurality of circumferentially related fountain and doctor blade assemblies on said turret, the doctor blades of said assemblies being spaced from said axis, conduit means coupled to said turret for alternatively delivering coating and cleaning fluid to each fountain for transfer to and cleaning of said roll, first means coupled between said frame and an end of said turret for indexing said turret about said axis, and second means coupled between said frame and an end of said turret for translating said turret radially away from said roll.

2. The press of claim 1 in which a pair of doctor blades are associated with each fountain.

3. A printing press or the like comprising a frame, a fluid transfer roll rotatably mounted on said frame, an elongated multiple position turret rotatably mounted on said frame and having an axis of rotation and positioned adjacent said roll, a plurality of circumferentially related fountain and doctor blade assemblies on said turret, the doctor blades of said assemblies being spaced from said axis, conduit means coupled to said turret for delivering fluid to each fountain for transfer to said roll, and means coupled between said turret and said frame for translating said turret and indexing said turret about said axis, a block-like subframe mounted on each end of said turret, gib means mounted on said frame adjacent each end of said turret, said block-like subframes riding in said gib means, and said translating and indexing means being coupled to said block-like subframes.

4. A method of operating a printing press or the like having a frame rotatably supporting a fluid transfer roll, providing a turret indexably, translatably mounted on said frame and having an indexing axis and with a plurality of circumferentially related sealed, fountain and doctor blade assemblies for supplying fluid to said roll, said doctor blades being spaced from said axis to sequentially engage said roll upon turret indexing, introducing a first coating fluid into a first assembly and completing a first application run using said first coating fluid, introducing a cleansing fluid into said first assembly to remove said first coating fluid therefrom, and from said fluid transfer roll, translating said turret out of fluid transfer relation with said roll and indexing said turret to position a second assembly in alignment with said roll, translating said second assembly into fluid transfer relation with said roll and delivering a second coating fluid to said roll to develop a second application run.

5. The method of claim 4 in which cleansing fluid including first a solvent and thereafter compressed air.

* * * * *